US006393780B1

(12) United States Patent
Jung

(10) Patent No.: US 6,393,780 B1
(45) **Date of Patent: *May 28, 2002**

(54) CLADDING FOR WINDOWS AND/OR DOORS

(75) Inventor: Horst Jung, Dietzenbach (DE)

(73) Assignee: Thomas Jung, Dreieich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/648,619

(22) Filed: Aug. 28, 2000

Related U.S. Application Data

(63) Continuation of application No. 09/398,756, filed on Sep. 17, 1999, now Pat. No. 6,138,428.

(51) Int. Cl.[7] ..... E06B 3/96

(52) U.S. Cl. ..... 52/211; 52/204.53; 52/716.2; 52/717.01; 52/213; 52/770

(58) Field of Search ..... 52/716.2, 717.01, 52/213, 770, 204.53, 211

(56) References Cited

U.S. PATENT DOCUMENTS 1,266,547 A * 5/1918 Baxter ..... 52/717.01
1,611,522 A * 12/1926 Gorkin ..... 52/770
2,186,458 A * 1/1940 Lehman ..... 52/213
2,994,413 A * 8/1961 Levy ..... 52/770
4,454,687 A * 6/1984 Baker ..... 49/419
5,230,180 A * 7/1993 Tweedt ..... 52/213
5,245,788 A * 9/1993 Riegelman ..... 49/465
5,566,524 A * 10/1996 Bettin ..... 52/717.01
5,887,392 A * 3/1999 Martin ..... 52/716.2
6,158,182 A * 12/2000 Biebuyck ..... 52/770

* cited by examiner

*Primary Examiner*—Carl D. Friedman
*Assistant Examiner*—Phi Dieu Tran A
(74) *Attorney, Agent, or Firm*—Dennison, Schultz & Dougherty

(57) ABSTRACT

The invention relates to a cladding (20, 22, 24) of profile material, in particular in the form of extruded aluminum profile material, in particular for windows and/or doors with fastening elements extending from the window or door or their frame and/or casement frame (10, 12) or parts thereof such as turning holders or eccentric screws, each having a head engaging in a relief-cut receiving channel of the profile material. To provide a cladding using prefabricated parts without the need for expensive modifications, independant of frame dimensions, in particular of the width of the frame piece to be covered, it is suggested that the profile material comprises a first and at least a second profile element (20, 22, 24), that the relief-cut receiving channel (58) is a first section of the first profile element arranged on the frame side from which profile element extends at least one second section limiting a groove-like receptacle (36, 38) in which runs an edge-side section of a second profile element (22, 24), and in that identical first profile elements are sections of the cladding regardless of the dimensions of frames or parts thereof to be clad.

7 Claims, 4 Drawing Sheets

CLADDING FOR WINDOWS AND/OR DOORS

Figure 1:
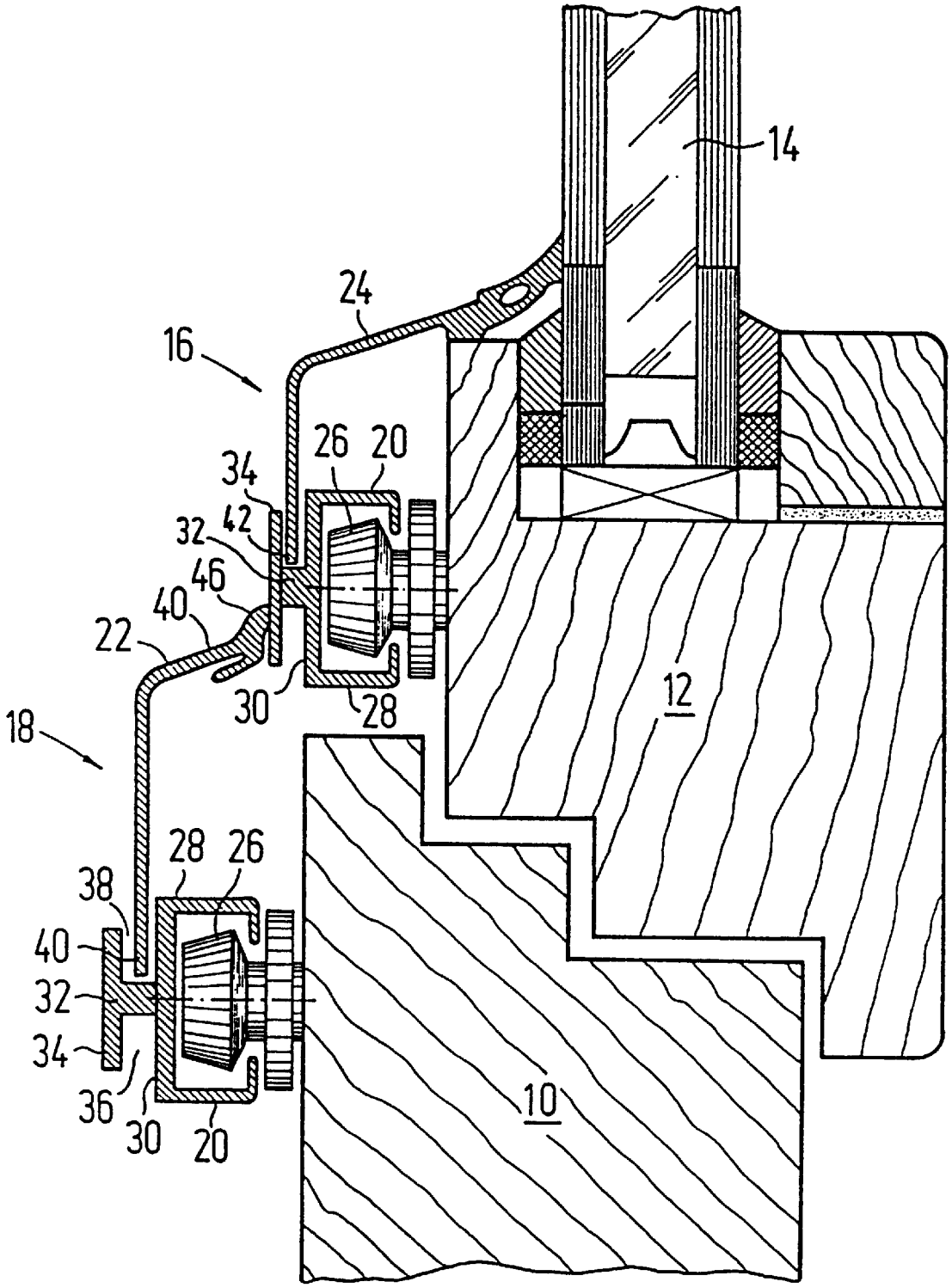

This application is a continuation of Ser. No. 09/398,756 filed Sep. 17, 1999 U.S. Pat. No. 6,138,428.

The invention relates to a cladding of profile material, in particular in the form of extruded aluminum profile material, in particular for windows and/or doors with fastening elements extending from the window or door or their frame and/or casement frame or parts thereof such as turning holders or eccentric screws, each having a head engaging in a relief-cut receiving channel of the profile material, where in particular the head is alignable with the receiving channel by turning or where the head is fixable in the receiving channel by pressing the profile material onto the head.

In order to protect in particular wood frames against the effects of weather or to renovate worn frames, the use is known of claddings comprising aluminum profile, for example, which hide the window frames or casement frames or bars inside them. It is here generally necessary for the cladding to be matched in respect of its dimensions individually to the frame dimensions to be covered, which is a drawback particularly in the case of old windows not made of industrially prefabricated parts. To remedy this, DE 295 17 566 U1 proposes a renovation system comprising prefabricated sections of profile material that can be matched up on the spot. Here the cladding of each frame part comprises a one-piece profile material, with the sections being cut to length for adjustment to frame pieces of differing width. If a transom has to be covered, two profile material sections of identical cross-section are used, between which is an intermediate piece extending above the height of the profile material sections.

In De 26 38 050 A1 a cladding with a relief-cut groove is described. A screw extends out of the casement and the head of the screw engages the relief-cut groove to hold the cladding in place.

The relief-cut channel is here a section of a profile material section using which one piece of a wood frame is clad to the required extent. For frames of differing piece widths, differing profile material forms are therefore necessary.

A window post cladding profile is known from DE 295 03 961 U1 that has two relief-cut receiving channels for fastening elements. Inside the plane formed by the receiving channels, further receiving channels extend from the profile's longitudinal edge, into which cladding profiles can be inserted in order to clad a post or mullion.

DE 78 28 037 U1 describes a facing for frames or frame parts in windows comprising a U-shaped or H-shaped profile attachable directly to the frame and an angled profile insertable into its groove. To attach the U-shaped or H-shaped profile to a window, it is necessary that the piece on the window side is longer than that on the angled profile side. As a result, the U-shaped or H-shaped profiles cannot be attached to narrow window frames or casement frames. Due to the type of connection, a rapid replacement of the entire facing itself is no longer possible.

An additional window frame is known from CH 568 465 A5 that comprises first and second profile parts that can be inserted into one another and then screwed together. In this case, the first profile part has a C-shaped profile section into which corner connection angles can be inserted in order to combine profile elements into a closed frame. The profile parts themselves can be completely prefabricated in the factory, with a dimensional adjustment being made to the frame embedded in the wall or to the window aperture.

DE-A 2 203 356 relates to a window or door that is clad by means of overlapping profiles preferably of aluminum. One of the profiles has a receptacle of C-shaped section on the window or door side for holders extending from the frame of the window or door. To that end, the frame is provided with slots into which a vertical beam of the holder is inserted and then secured.

The problem underlying the present invention is to develop a cladding of the type mentioned at the outset such that regardless of frame dimensions, in particular of the width of the frame piece to be covered, a cladding is possible using prefabricated parts without the need for expensive modifications. Here it should be possible to clad in particular transoms and posts, frames or bars. It should also be possible to clad windows and doors made not of wood, but of other frame materials such as plastic or metal. Furthermore, simple attachment of the cladding should be possible.

The problem is solved in accordance with the invention substantially in that the profile material comprises a first and at least a second profile element, in that the relief-cut receiving channel is a first section of the first profile element arranged on the frame side, from which profile element extends at least one second section limiting a groove-like receptacle in which runs an edge-side section of a second profile element, and in that identical first profile elements are sections of the cladding regardless of the dimensions of frames or parts thereof to be clad.

A cladding is proposed in accordance with the invention that comprises two profile elements detachably connectable to one another, the first profile element being connectable to the window frame or casement frame or parts thereof via the fastening elements preferably designed as eccentric screws or turning holders. As a result of this, only a small area of the frame to be clad is needed to attach the cladding, this being a possibility not afforded by the cladding described in DE 78 28 037 U1 in particular. The use of eccentric screws has i the further benefit that simple mounting/removal of the first profile element and hence of the cladding is possible. There is also the possibility of pressing or clipping the profile element with the receiving channel onto the head of the fastener.

In particular, it is provided that the first profile element is made up in section of a C-shaped profile and at last one T-shaped profile, the center piece of the latter extending from the transverse piece of the C-shaped profile or from a side piece of the C-shaped profile. As a result two or four groove-like receptacles are provided that are limited by sections of the C-shaped profile and of the T-shaped profile (s), with the respective bottom of the groove-like receptacle being formed by the center piece of the respective T-shaped profile.

A further embodiment of the invention provides that the receiving channel has a hat-like cross-section with longitudinal slot limited by webs, inside which slot extends the head of the fastening element. Here the webs engage at the edges in groove-like depressed portions or cutouts in the head.

The hat-like cross-section of the receiving channel can be designed symmetrically or unsymmetrically. Irrespective of this, the receiving channel preferably comprises a first chamber on the slot side and an adjacent second chamber of lower width which is limited on the outside by an outer wall running parallel to the webs, projecting beyond the second chamber and forming a lateral limit for at least one groove-like receptacle. Here the outer wall of the second chamber can have a width corresponding to the clear spacing of the outer faces of the walls limiting the first chamber.

To provide a first profile element for connection to a window frame, this element can be symmetrically designed in respect of its receiving channel, so that initially a groove-like receptacle is obtained.

With a symmetrical design of the first profile element, it is provided in particular that each longitudinal side piece of the profile element has an S-shaped geometry in section, with the longitudinal side piece being symmetrically designed relative to a central plane of the profile element.

Alternatively, the profile element can be designed asymmetrically relative to its receiving channel, where a groove-like receptacle extends vertically from the outer wall limiting the second chamber, said receptacle being limited on the longitudinal edge side by a section of a side wall limiting the first and second chambers, corresponding to a longitudinal side piece.

It is also possible for two groove-like receptacles running vertically to one another to extend from or be limited by the outer wall, where one section of the outer wall forms the bottom of one of the groove-like receptacles and a further section of the outer wall is a side wall of the other groove-like receptacle.

In particular, in the design of the receiving channel in the form of two chambers differing from one another in their width dimensions the result is a low height of the first profile element when the head of the fastening element, preferably designed as an eccentric screw, is only inside the receiving channel in some areas. The fact that the groove-like receptacles can be in different planes results in a high flexibility and versatility in use for the cladding of required window frames and casement frames of windows and doors.

An edge-side section of a second profile element can then be inserted into the respective groove-like receptacle in order to provide the required cladding or curtain pellet.

In particular, a cladding is proposed that comprises a first profile part made up of a C-shaped profile and a T-shaped profile, with the center piece of the T-shaped profile projecting in the center from the transverse piece of the C-shaped profile. The first profile part forms the basis for the respective cladding of a piece, a bar, a post etc., where the receiving channels limited by the outer transverse piece of the T-shaped section are receptacles for edge areas of second profile parts, in which receptacles engage second profile parts having the required geometries or dimensions for the necessary cladding of the frame or parts thereof. The second profile parts can then be connected in the usual way to the frame.

The fact that the cladding of a bar, a frame piece, a transom or a post etc. is always made up of two elements, with the first profile part forming the basic element, means that any frame of a window or door can be clad, and only requires adjustment of the second profile parts to the respective frame dimensions. Since the cladding itself is connected to the frame via the first profile parts, it is only necessary to provide fastening elements on the frame to be clad with the necessary spacing, in order to then fix the first profile part by so-called clipping. The fastening elements can be designed as eccentric screws in order to permit not only secure fastening, but also, to the necessary extent, removal of the first profile part.

To permit simple insertion of the edge areas of the second profile parts into the receiving channels while simultaneously achieving perfect fixing, it is provided that the transverse piece of the C-shaped profile has a width greater than that of the transverse piece of the T-shaped profile.

Furthermore, the transverse piece of the T-shaped profile should be chamfered on the longitudinal edge side so that a smooth transition from the transverse piece of the T-shaped profile into the second profile part fixed by the latter is achieved. The second profile part itself preferably has the geometry of an 'L', where the piece running obliquely to the transverse piece of the T-shaped profile runs in the direction of the frame to be clad.

Further details, advantages and features of the invention are shown not only in the claims and in the features they contain—singly and/or in combination—but also in the following description of preferred embodiments shown in the drawing.

Figure 2:
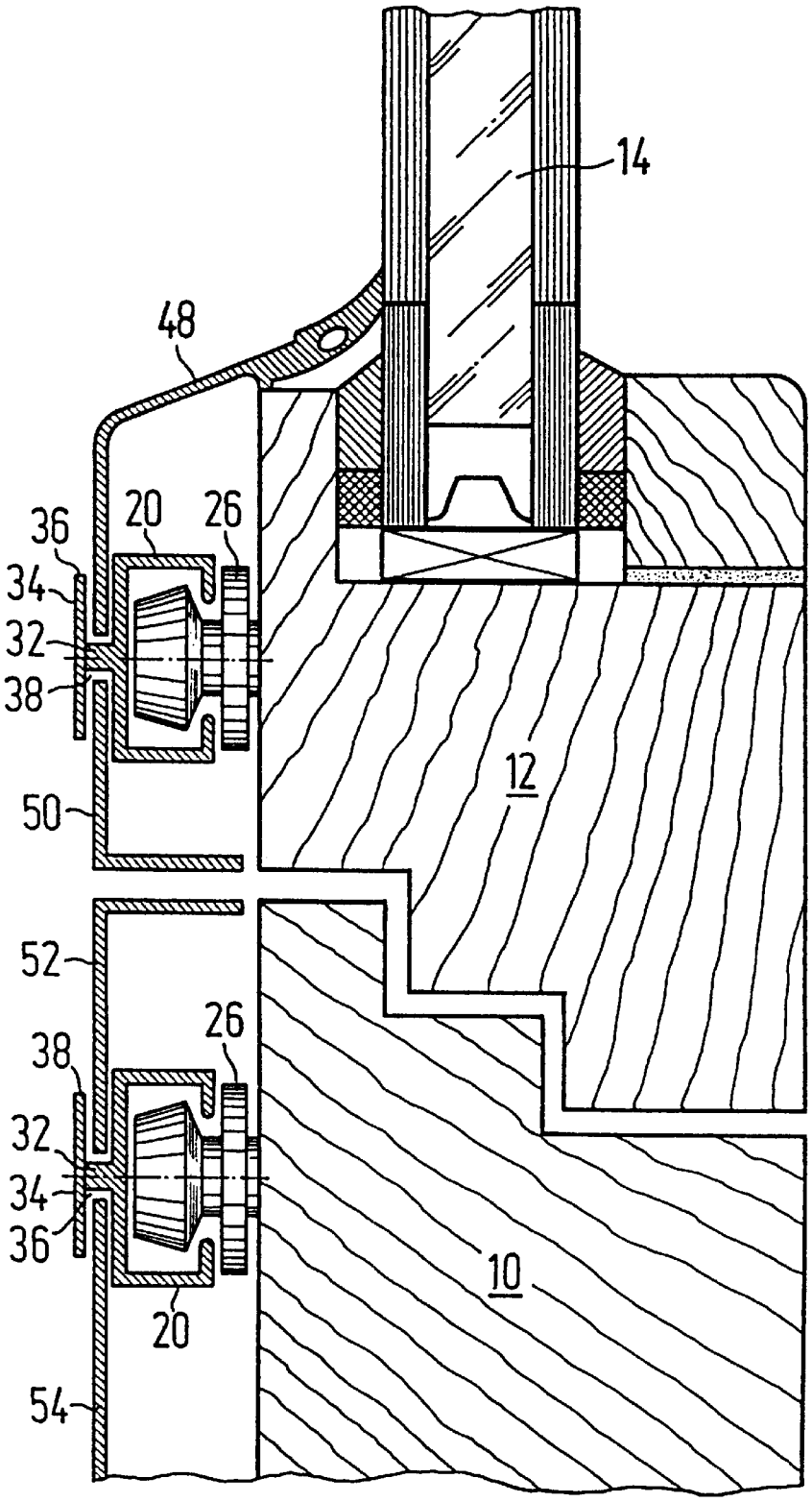
Figure 3:
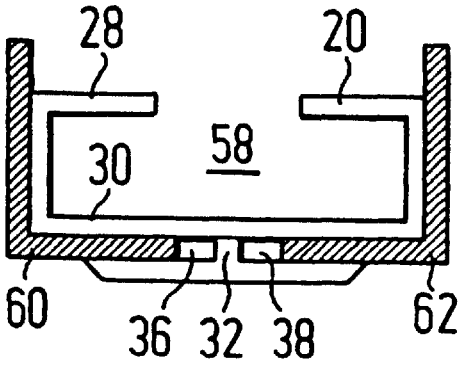
Figure 4:
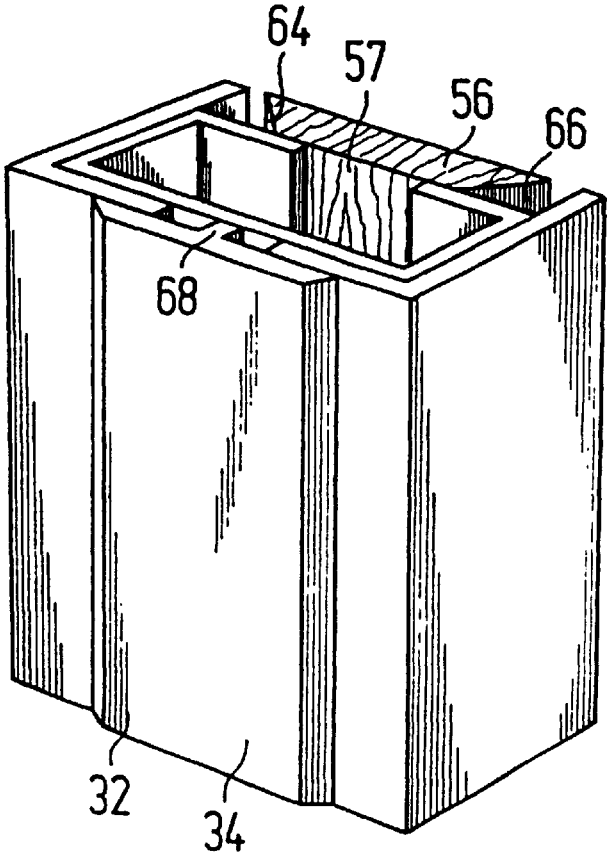
Figure 5:
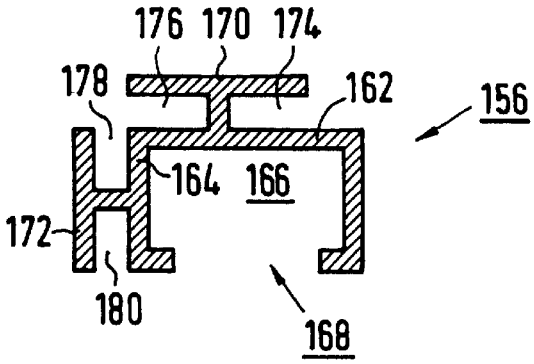
Figure 6:
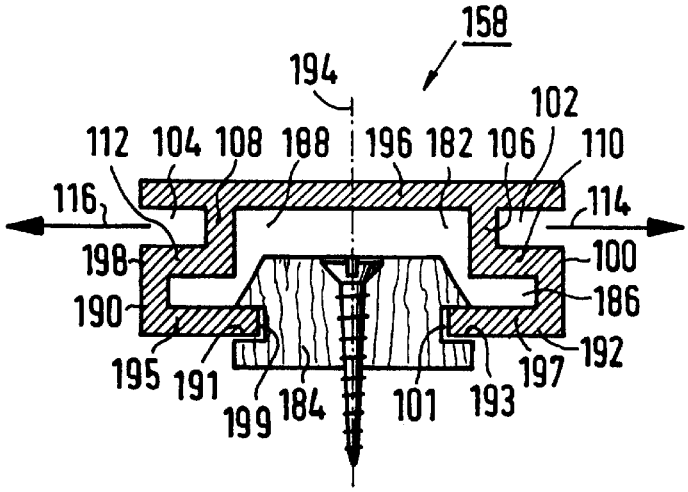
Figure 7:
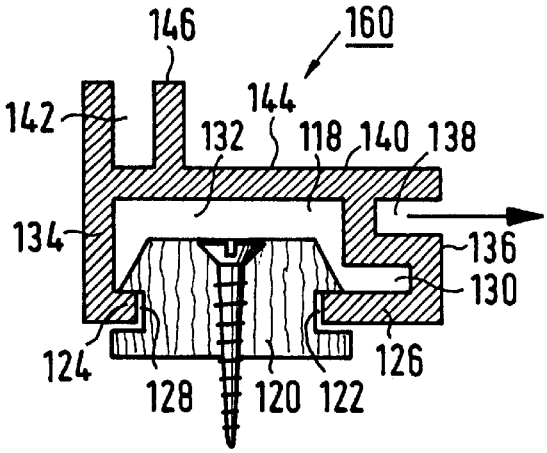

In the drawing,

FIG. 1 shows a section through a first embodiment of a cladding of a window, FIG. 2 shows a section through a second embodiment of a cladding of a window, FIG. 3 shows a cross-section of a cladding, FIG. 4 shows a perspective view of a cladding of a bar of a window in cutaway form, FIG. 5 shows a cross-section through a further embodiment of a first profile element, FIG. 6 shows a cross-section through a third embodiment of a first profile element, FIG. 7 shows a cross-section through a fourth embodiment of a first profile element.

Although the invention is explained in the embodiments with reference to windows, this does not constitute a restriction, and the teachings in accordance with the invention can be used wherever elements in houses and flats in particular require cladding. The predominant use is in windows and doors.

FIG. 1 thus shows a section through a window comprising a window frame 10 and casement frame 12 swivelable thereto with pane 14. On the outside, the window frame 10 and the casement frame 12 are covered by a cladding 16, 18 to the extent that when the window is closed the frames 10, 12 preferably made of wood are no longer visible. Of course the covering of frames made of other materials, such as plastic or metal, is also possible in accordance with the following teachings.

On the one hand, the claddings 16, 18 protect the frames 10, 12, and on the other hand the replacement of worn frames is no longer necessary thanks to the claddings 16, 18.

Each cladding 16, 18 comprises preferably extruded aluminum profile elements 20, 22 or 24, where the first profile part 20 extends directly from the frames 10, 12 via a fastening element such as turning holder or eccentric screw 26. The first profile part 20 comprises a first section designed as a C-shaped profile 28, from the outside of which, i.e. its transverse piece, extends a T-shaped profile 32 as the second section whose transverse piece 34 is parallel to the transverse piece 30 of the C-shaped profile 28. The width of the transverse piece 34 is shorter than that of the transverse piece 30 of the C-shaped profile 28.

Receiving channels 36, 38 are provided between the transverse piece 30 of the C-shaped profile 28 and the transverse piece 34 of the T-shaped profile 32, into which receiving channels edge sections 40, 42 of the second profile parts 22, 24 respectively of differing geometry and/or dimensions can be fitted or inserted. Here the second profile part 24, which can, with its side section angled in the direction of the casement frame 12, extend from the first profile part 20 connected to the window frame 10 as far as the outside of the transverse piece 34 of the T-shaped profile 32 of the first profile part 20 connected to the casement frame 12. When the casement frame 12 is closed the piece 40 can contact the outside of the transverse piece 34 with a sealing lip 46.

The second profile part 24 extending from the casement frame 12 has, in comparison with the profile 22 of the window frame 10, a different geometry, without the need for chances relative to the respective first profile part 20. As a result, it is possible with simple measures to achieve any required cladding geometry, and to make use of prefabricated elements.

This is also made clear by FIG. 2, where identical elements are provided with identical reference numbers. Here a second profile part 48, 50 or 52, 54 extends from the receiving channels 36, 38 respectively of the T-shaped profile 32 and recognizably has a required geometry and/or dimensions to cover the casement frame 12 or window frame 10 to the required extent and hence to clad it. Regardless of this, the first profile parts 20 are of identical design.

Identical first profile parts 20 can also be used to clad for example bars 56 of a window (FIGS. 3, 4). Connecting elements, not shown, in accordance with FIGS. 1 and 2, i.e. turning holders or eccentric screws, extend from a bar outer surface 57 and engage in the receiving channel 58 formed by the C-shaped profile 28 of the first profile part 20. For cladding of the bar 56, L-shaped angled second profile parts 60, 62 then extend from the receiving channels 36, 38 formed between the T-shaped profile 32 and the C-shaped profile 28 of the first profile part 20, in order to cover in this way the longitudinal pieces 64 and 66 of the bar 56.

As made clear in particular by the sectional views in FIGS. 3 and 4, the T-shaped profile 32 extends with its central piece 68 from the center of the outer surface of the transverse piece 30 of the C-shaped profile 28. The width of the transverse piece 34 is recognizably narrower than that of the transverse piece 30 of the C-shaped profile 28. In other words, the first profile part 20 comprises a C-shaped profile 28 and an H-shaped profile limited on the outside by the T-shaped profile and having a common piece formed by the transverse piece 30 of the C-shaped profile 28. Since the outer transverse piece 32 is shorter than the inner transverse piece 30 of the C-shaped profile 28, the H-shaped profile thereby formed accordingly has outer pieces of differing length.

The longitudinal edges of the transverse piece 34 itself should be chamfered to achieve a smooth transition between the second profile parts 60, 62 and the transverse piece of the first profile part 20. In this case, the transverse piece has a trapezoidal section of which the long base piece faces the C-shaped profile 28.

The fastening or removal of the first profile parts 20, into whose C-shaped profile sections 28 project heads of the eccentric screws or turning holders 26, is achieved in that by turning the latter the heads are aligned with the C-shaped profile sections 28 such that either the effective width of the head cannot pass through the slot of the C-shaped profile 28 (fastening) or the effective width is narrower than that of the slot (loosening or attaching).

Thanks to the type of the fastening elements, it is not necessary to modify the frame to be clad. The attachment of the cladding is achieved by moving it in the direction of the fastening element, i.e. vertical to the plane formed by the frame, so that the heads of the fastening elements penetrate into the C-shaped profiles. Then the fastening elements are rotated, so that the cladding can no longer be detached from the heads. These measures apply for eccentric screws as the fastening means. It is of course also possible to clip the cladding onto the heads. In this case, the heads are formed rotationally symmetrical to the longitudinal axis of the fastening element. Detachment of the cladding by rotating the heads is then no longer possible.

In FIGS. 5 to 7, further preferred embodiments of first profile elements 156, 158 and 160 are shown that are connectable to a window frame 10 or casement frame 12 preferably using eccentric screws or connecting elements having eccentric heads. The profile element 156 shown in FIG. 5 is intended in particular for fastening to a casement frame, and the profile elements 158, 160 shown in FIGS. 6 and 7 for fastening to window frames, however the invention should not be construed as being limited to this arrangement.

The profile element 156 in FIG. 5 differs from that in FIGS. 1 and 2 in that a T-shaped profile 170, 172 providing a receiving channel 166 extends not only from the transverse piece 162, but also from at least one side piece 164. The T-shaped profiles therefore provide a total of four outer groove-like receptacles 174, 176, 178, 180 for second profile elements or their edge sections. Here the T-shaped profiles 170, 172 do not necessarily have to extend from the center of the respective piece 162, 164, as the T-shaped profile 170 makes clear.

In the case of the profile element 158 according to FIG. 6, a receiving channel 182 of hat-shaped section is provided in which a head 184 of a fastening element such as an eccentric screw engages in some sections. The receiving channel 182 is composed here of an outer first chamber 186 and an inner second chamber 188 of lesser width. On the longitudinal edge side, the chambers 186, 188 are accordingly limited by longitudinal pieces 190, 192 of S-shaped section which are symmetrical to a central line 194 through the profile element 158. The free longitudinal edges 191, 193 on the frame-side limits or webs 195, 197 engage in groove-like recesses 199, 101 of the head 184, thereby ensuring a secure fixing.

The outer wall 196 limiting the inner chamber 188 extends laterally as far as a plane of the side pieces 190, 192 formed by the respective free outer surfaces 198, 100, thereby creating groove-like receptacles 102, 104 into which edge areas of second profile elements can in turn be inserted. The receptacles 102, 104 accordingly run parallel to the front-side outer wall 196.

In other words, the groove-like receptacles 102, 104 are limited by longitudinal side walls 106, 108, sections of the outer wall 196 of the inner chamber 188, and inner walls 110, 112 of the outer chamber 186 that run parallel to the outer wall 196.

The arrows 114, 116 shown in FIG. 6 are intended to indicate the movement of second profile elements insertable into the groove-like receptacles or outer receiving channels 102, 104.

While the profile element 158 in FIG. 6 is designed symmetrical to the longitudinal central plane 194, an unsymmetrical geometry is shown in FIG. 7.

The profile element 160 has a receiving channel 118 that is designed in L-shaped section and inside which extends a head 120 of a fastening element in some sections. As in FIG. 6, longitudinal edges 122, 124 of a frame-side web 126 that limit a slot engage in corresponding groove-like recesses 128 of the head 120. If the latter or the screw element as a whole is turned, problem-free removal of the profile element 160 from the fastening element can be achieved thanks to the unsymmetrical, i.e. eccentric design of the screw element.

The receiving channel 118 also comprises an outer chamber 130 on the web side and an inner chamber 132 having a lower width than the outer one. Unlike in the embodiment according to FIG. 6, the outer and inner chambers 130, 132 merge flush with one another in the area of a longitudinal piece 134, whereas in the area of the opposite longitudinal piece 136 having an S-shaped section a step is formed. This step represents the inner limit of a first outer receiving channel 138 which is limited on the outside by a section of an outer wall 140 that is also the outer limit of the inner chamber 132 of the receiving channel 118.

Vertical to the first receiving channel 138 is a second receiving channel 142 that extends from the outer surface 144 of the outer wall 140. A lateral limit of the receiving channel 142 is formed by a section of the longitudinal side wall 134, parallel to which and extending from the outer wall 140 extends a web-like projection 146 that is the further lateral limit of the groove-like receptacle 142. The fastening or removal of the first profile parts with the fastening elements or the heads is possible in accordance with the explanations shown in FIGS. 1–4.

What is claimed is:

1. A cladding system for a building member comprising;

a headed fastener secured to and extending outwardly from the member; and a length of profile material adapted to be connected to said headed fastener;

wherein said length of profile material comprises a first profile element having a first side with an opening into a chamber, said chamber having a width greater than the width of said opening, into which the head of said headed fastener is received, a second side having a first end connected to said first side and a second end connected to a third side, said third side forming with a portion of said second side a first elongated groove for removably receiving an edge section of a second length of profile material.

2. The cladding of claim 1 wherein said length of profile material includes a fourth side connecting said first side and said third side and including a portion extending beyond said third side, said cladding further including a wall member extending from said third side parallel to said fourth side.

3. The cladding of claim 1 wherein said length of profile material is extruded.

4. The cladding of claim 3 wherein said profile material is formed from aluminum.

5. A cladding system for a building member comprising;

a headed fastener secured to and extending outwardly from the member; and a length of profile material adapted to be connected to said headed fastener;

wherein said length of profile material comprises a first profile element having a first side with an opening into a chamber, said chamber having a width greater than the width of said opening, into which the head of said headed fastener is received, a second side and a third side, said third side forming with a portion of said second side a first elongated groove for removably receiving an edge section of a second length of profile material and including a second elongated groove formed between said third side and a portion of a fourth side.

6. A cladding system for covering a window sash and frame comprising;

at least one headed fastener secured to and extending outwardly from the sash;

at least one headed fastener secured to and extending outwardly from the frame;

a length of sash profile material adapted to be connected to at least one headed fastener in said sash; and a length of frame profile material adapted to be connected to said at least one headed fastener in said frame;

wherein said length of sash profile material and said length of frame profile material each comprise a first profile element having an inner side with an opening into a chamber, said chamber having a width greater than the width of said opening, into which the head of said headed fastener is received, a second side having a first end connected to said first side and a second end connected to a third side forming with a portion of said second side a first elongated groove for removably receiving an edge section of a second length of profile material.

7. A cladding system for a building member comprising;

a headed fastener secured to and extending outwardly from the member; and a length of profile material adapted to be connected to said headed fastener;

wherein said length of profile material comprises a first profile element having a first side with an opening into a chamber, said chamber having a width greater than the width of said opening, into which the head of said headed fastener is received, a second side and a third side, said third side defining a portion of an elongated groove for removably receiving an edge section of a second length of profile material.

* * * * *